US007931265B2

(12) United States Patent
Okamoto

(10) Patent No.: US 7,931,265 B2
(45) Date of Patent: Apr. 26, 2011

(54) SHEET FEEDER AND IMAGE FORMING DEVICE PROVIDED WITH THE SAME

(75) Inventor: Tsugio Okamoto, Gifu (JP)

(73) Assignee: Brother Kogyo Kabushiki Kaisha, Nagoya-shi, Aichi (JP)

( * ) Notice: Subject to any disclaimer, the term of this patent is extended or adjusted under 35 U.S.C. 154(b) by 162 days.

(21) Appl. No.: 12/369,987

(22) Filed: Feb. 12, 2009

(65) Prior Publication Data

US 2009/0200729 A1 Aug. 13, 2009

(30) Foreign Application Priority Data

Feb. 12, 2008 (JP) ..... 2008-030697

(51) Int. Cl.
*B65H 3/06* (2006.01)

(52) U.S. Cl. ..... 271/114; 271/902; 74/435

(58) Field of Classification Search ..... 271/114, 271/902; 74/434, 435, 437
See application file for complete search history.

(56) References Cited

U.S. PATENT DOCUMENTS 1,804,138 A * 5/1931 Yeider ..... 74/74
5,195,735 A * 3/1993 Sellers ..... 271/21
5,276,466 A * 1/1994 Tsukada et al. ..... 346/139 R
2006/0180986 A1 8/2006 Hattori
2006/0180987 A1* 8/2006 Hattori ..... 271/117

FOREIGN PATENT DOCUMENTS

| | | |
|---|---|---|
| JP | HEI 3-51230 | 3/1991 |
| JP | 03-105139 | 10/1991 |
| JP | HEI 3-105139 | 10/1991 |
| JP | HEI 11-292316 | 10/1999 |
| JP | 2001-180831 | 3/2001 |
| JP | 2005-263369 | 8/2005 |
| JP | 2006-176321 | 7/2006 |

* cited by examiner

*Primary Examiner* — Stefanos Karmis
*Assistant Examiner* — Ernesto Suarez
(74) *Attorney, Agent, or Firm* — Banner & Witcoff, Ltd.

(57) ABSTRACT

A sheet feeder includes a feed roller feeding a sheet while rotating in a feeding direction, a driving gear that rotates in a predetermined direction and transmits a driving force, a first gear mechanism transmitting the force to the feed roller to rotate the feed roller in a reverse direction opposite to the feeding direction, and a second gear mechanism transmitting the force to the feed roller to rotate the feed roller in the feeding direction. The driving gear includes a first engaging member that engages with the first gear mechanism and transmits the force to the first gear mechanism at a rotational angle of the driving gear within a first range, and a second engaging member that engages with the second gear mechanism and transmits the force to the second gear mechanism at the rotational angle within a second range having no common range with the first range.

20 Claims, 7 Drawing Sheets

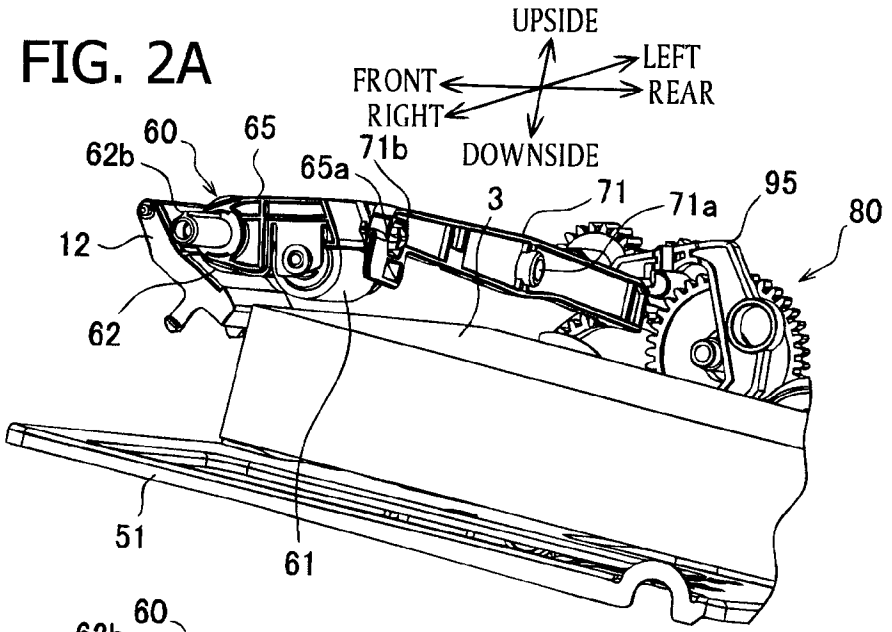
FIG. 2A
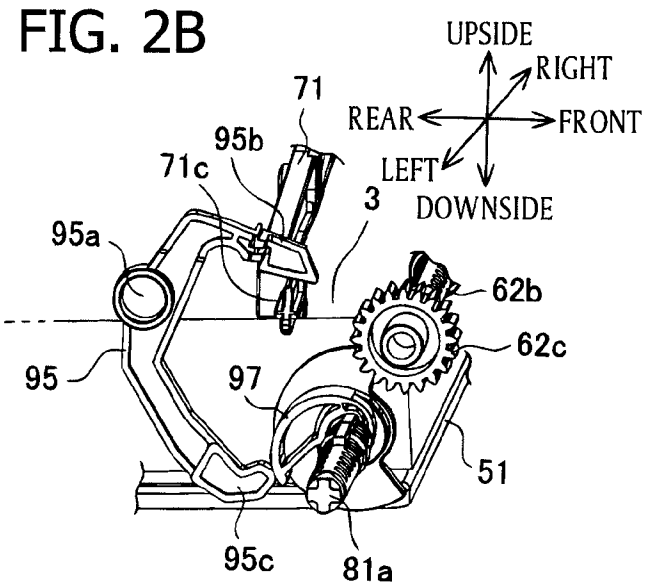
FIG. 2B
FIG. 2C
FIG. 2D

SHEET FEEDER AND IMAGE FORMING DEVICE PROVIDED WITH THE SAME

CROSS-REFERENCE TO RELATED APPLICATION

This application claims priority under 35 U.S.C. §119 from Japanese Patent Application No. 2008-030697 filed on Feb. 12, 2008. The entire subject matter of the application is incorporated herein by reference.

BACKGROUND

1. Technical Field

The following description relates to one or more sheet feeding techniques with a feed roller configured to contact and feed a top sheet of a stack of sheets.

2. Related Art

A sheet feeder has been proposed, which is provided with a feed roller adopted to contact and feed a top sheet of a stack of sheets and configured to convey the top sheet to an image forming unit by (normally) rotating the feed roller. Further, for this kind of sheet feeder, a technique, in which the top sheet is fed without carrying two or more sheets together at once by firstly rotating the feed roller reversely to partially curl the top sheet and secondly rotating the feed roller normally, has been proposed, for example, in Japanese Patent Provisional Publication No. HE 11-292316 (hereinafter, simply referred to as '316 Publication).

SUMMARY

However, according to the technique disclosed in '316 Publication, in order to rotate the feed roller reversely or normally, it is required to switch an operation mode of a motor for driving the feed roller between reverse rotation and normal rotation. Therefore, for instance, the feed roller requires a motor provided only for the feed roller, and it results in a complicated configuration of the sheet feeder.

Aspects of the present invention are advantageous to provide one or more improved sheet feeders and image forming devices provided with the sheet feeders that make it possible to prevent two or more sheets from being fed together at once by reversely rotating a feed roller and thereafter normally rotating the feed roller even though a driving force is applied only in a predetermined rotational direction.

According to aspects of the present invention, a sheet feeder is provided, which includes a feed roller configured to contact and feed a top sheet of a stack of sheets while rotating in a predetermined feeding direction, a driving gear configured to be rotated in a predetermined direction and transmit a driving force, a first gear mechanism configured to transmit the driving force from the driving gear to the feed roller so as to rotate the feed roller in a reverse direction opposite to the feeding direction, and a second gear mechanism configured to transmit the driving force from the driving gear to the feed roller so as to rotate the feed roller in the feeding direction. The driving gear includes a first engaging member configured to engage with the first gear mechanism and transmit the driving force to the first gear mechanism when a rotational angle of the driving gear is within a first range, and a second engaging member configured to engage with the second gear mechanism and transmit the driving force to the second gear mechanism when the rotational angle of the driving gear is within a second range that has no common range with the first range.

In some aspects of the present invention, the driving gear is driven and rotated in a predetermined direction. Further, the driving gear is provided with the first engaging member adopted to engage with the first gear mechanism when the rotational angle of the driving gear is within the first range. When receiving the driving force from the driving gear, the first gear mechanism transmits the driving force to the feed roller to rotate the feed roller in the reverse direction. In other words, when the rotational angle of the driving gear is within the first range, the feed roller can be rotated in the reverse direction by the driving force transmitted from the driving gear, which is rotating in the predetermined direction, via the first gear mechanism.

In addition, the driving gear is provided with the second engaging member adopted to engage with the second gear mechanism when the rotational angle of the driving gear is within the second range. When receiving the driving force from the driving gear, the second gear mechanism transmits the driving force to the feed roller to rotate the feed roller in the feeding direction. In other words, when the rotational angle of the driving gear is within the second range, the feed roller can be rotated in the feeding direction by the driving force transmitted from the driving gear, which is rotating in the predetermined direction, via the second gear mechanism.

Therefore, even though the driving gear is rotated in the predetermined direction, when the driving gear is rotated in the predetermined direction from a rotational angle within the first range to a rotational angle within the second range, it is possible to reversely rotate the feed roller and thereafter normally rotate the feed roller, and thus to prevent two or more sheets from being fed together at once.

According to aspects of the present invention, further provided is an image forming device, which includes a sheet feeder configured to feed a top sheet of a stack of sheets, and an image forming unit configured to form an image on the sheet fed by the sheet feeder. The sheet feeder includes a feed roller configured to contact and feed the top sheet of the stack of sheets while rotating in a predetermined feeding direction, a driving gear configured to be rotated in a predetermined direction and transmit a driving force, a first gear mechanism configured to transmit the driving force from the driving gear to the feed roller so as to rotate the feed roller in a reverse direction opposite to the feeding direction, and a second gear mechanism configured to transmit the driving force from the driving gear to the feed roller so as to rotate the feed roller in the feeding direction. The driving gear includes a first engaging member configured to engage with the first gear mechanism and transmit the driving force to the first gear mechanism when a rotational angle of the driving gear is within a first range, and a second engaging member configured to engage with the second gear mechanism and transmit the driving force to the second gear mechanism when the rotational angle of the driving gear is within a second range that has no common range with the first range.

According to the image forming device configured as above, the same effects as the aforementioned sheet feeder can be provided.

BRIEF DESCRIPTION OF THE ACCOMPANYING DRAWINGS

FIGS. 2A to 2D are perspective views showing a gear mechanism configured to vertically drive a feed roller of the laser printer in the embodiment according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect.

Figure 1:
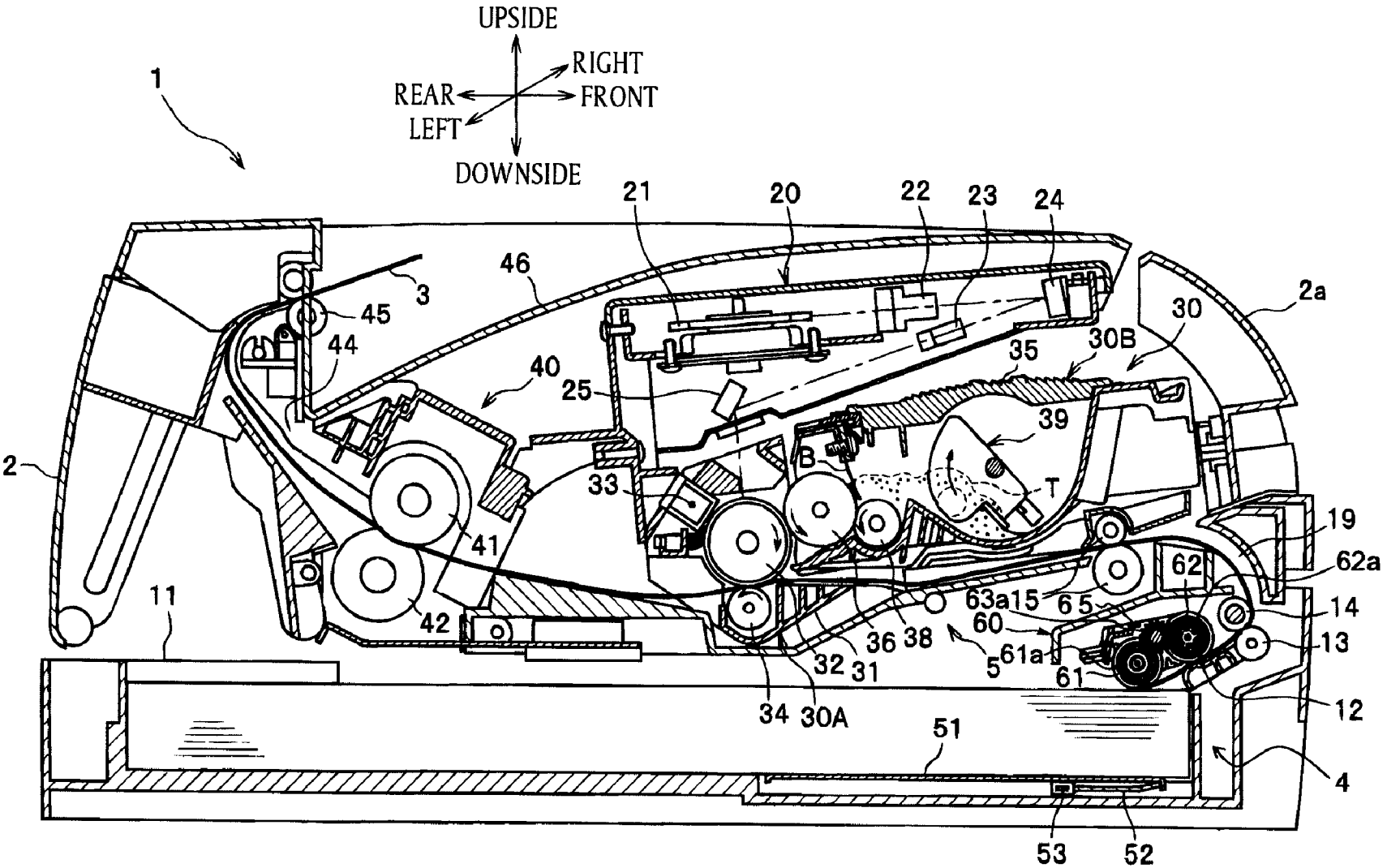
FIG. 1 is a cross-sectional side view schematically showing a configuration of a laser printer in an embodiment according to one or more aspects of the present invention.

Hereinafter, an embodiment according to aspects of the present invention will be described with reference to the accompany drawings. FIG. 1 is a cross-sectional view schematically showing an internal configuration of a laser printer 1 in an embodiment according to aspects of the present invention. It is noted that the following description will be given with a right side and a near side in FIG. 1 respectively defined as a front side and a left side.

1. Overall Configuration of Laser Printer

As shown in FIG. 1, the laser printer 1 includes, in a main body casing 2, a feeder unit 4 configured to feed a sheet 3 and an image forming unit 5 configured to form an image on the sheet 3. Further, the laser printer 1 has a front cover 2*a* provided at the front side of the main body casing 2. The front cover 2*a* is configured to be openable and closable, and a below-mentioned process cartridge 30 can be attached and detached through an opening formed when the front cover 2*a* is opened.

1. 1. Configuration of Feeder Unit

The feeder unit 4 includes a sheet feed tray 11 detachably attached to a bottom inside the main body casing 2, a pressing plate 51 provided under a stack of sheets 3 at a lower side of the sheet feed tray 11, which plate is swingably configured such that a front side thereof rise to lift the stack of sheets 3 in a sheet feed operation, and a lift plate 52 provided under the pressing plate 51 to lift the pressing plate 51 from beneath. The lift plate 52 is rotatably supported at a rear end thereof by the sheet feed tray 11. Further, the lift plate 52 is configured to be revolved around the rear end 53 by a driving force from a device main body and lift the pressing plate 51. It is noted that a configuration of such a lift plate 52 is disclosed, for example, in Japanese Patent Provisional Publication No. 2006-176321. Therefore, detailed explanation of the lift plate 52 will be omitted. Additionally, in this specification, the "device main body" represents portions of the laser printer 1 to be left when the sheet feed tray 11 and components attached to the sheet feed tray 11 are excluded from the laser printer 1.

In addition, a feed roller 61 is provided at an upper front side of the sheet feed tray 11, and configured to contact, from above, a top sheet of the stack of sheets 3. In front of the feed roller 61, a separation roller 62 is disposed. A separation pad 12 made of resilient material is disposed to face the separation roller 62, and configured to press the sheet 3 conveyed by the separation roller 62 against an outer circumferential surface of the separation roller 62 from a side of the sheet 3 opposite to a side in contact with the outer circumferential surface of the separation roller 62. Therefore, the sheet 3 fed by the feed roller 61 is held between the separation roller 62 and the separation pad 12, and conveyed further separately from other sheets. In further front of the separation roller 62, a sheet powder removing roller 13 and an opposed roller 14 are disposed to face one another. The sheet 3 passes between the two rollers 13 and 14, and thereafter turns around along a carrying route 19 toward a rear side. In addition, above the feed roller 61, a pair of registration rollers 15 is provided.

In the feeder 4 configured as above, the stack of sheets 3 in the sheet feed tray 11 is lifted by the lift plate 52 and the pressing plate 51, and the top sheet 3 is fed by the feed roller 61 toward the separation roller 62. Further, only the top sheet 3 is fed toward the opposite roller 14 due to friction between the separation roller 62 and the separation pad 12. Thus, the sheet 3 is conveyed to the image forming unit 5 on the sheet-by-sheet basis.

1.2. Configuration of Image Forming Unit

The image forming unit 5 provided inside the main body casing 2 above the feeder 4 includes a scanner unit 20, a process cartridge 30, and a fixing unit 40 as mentioned below. In addition, the image forming unit 5 is adopted to form an image on the sheet 3 in a so-called electrophotographic method.

1.2.1. Configuration of Scanner Unit

The scanner unit 20 is provided at an upper side in the main body casing 2. The scanner unit 20 includes a laser emitting unit (not shown), a polygon mirror 21 configured to be driven and rotated, lenses 22 and 23, and reflecting mirrors 24 and 25. A laser beam emitted by the laser emitting unit based on image data is, as indicated by a chain line, incident sequentially onto the polygon mirror 21, the lens 22, the reflecting mirror 24, the lens 23, and the reflecting mirror 25. Then, the laser beam is incident onto and fast scanned on a surface of a photoconductive drum 32 of the process cartridge 30.

1.2.2. Configuration of Process Cartridge

The process cartridge 30 is provided under the scanner unit 20 and configured to be detachably attached to the main body casing 2. The process cartridge 30 includes a photoconductive body cartridge 30A configured to support the photoconductive drum 32 and a developer cartridge 30B configured to be detachably attached to the photoconductive cartridge 30A and accommodate toner T as developer.

The photoconductive body cartridge 30A includes, inside a photoconductive body case 31 configured to form an outer frame, the photoconductive drum 32, a scorotron charger 33, and a transfer roller 34. The developer cartridge 30B is detachably attached to the photoconductive cartridge 30A, and has a development roller 36, a supply roller 38, and an agitator 39 rotatably provided in the developer case 35 adapted to accommodate the developer. The toner T in the developer case 35 is supplied onto the development roller 36 owing to rotation of the supply roller 38 in an arrow direction (counterclockwise direction). At this time, the toner T is positively charged due to friction between the supply roller 38 and development roller 36. The toner T supplied onto the development roller 36 goes into between a layer thickness regulating blade B and the development roller 36 along with rotation of the development roller 36 in an arrow direction (counterclockwise direction). Thereby, the toner T is held on the development roller 36 as a thin layer with an even thickness.

The photoconductive drum 32 is supported by the photoconductive body case 31 coupled with the developer cartridge 30B, so as to be rotatable in an arrow direction (clockwise direction). The photoconductive drum 32 is configured with a drum main body earthed and a positive electric photoconductive layer on a surface thereof.

The scorotron charger 33 is disposed above the photoconductive drum 32 so as to face the photoconductive drum 32 at a predetermined distance therefrom. The scorotron charger 33 is configured to induce corona discharge from a wire such as a tungsten wire and to charge the surface of the photoconductive drum 32 positively and evenly.

The transfer roller 34 is disposed beneath the photoconductive drum 32 so as to establish contact with the photoconductive drum 32. The transfer roller 34 is supported rotatably in the arrow direction (counterclockwise direction). The transfer roller 34 is configured with a metal roller shaft covered with electrically conductive rubber material. The transfer roller 34 has a transfer bias applied under constant current control in a transfer operation.

The surface of the photoconductive drum 32 is charged positively and evenly by the scorotron charger 33 along with rotation of the photoconductive drum 32 and thereafter disposed to fast scanning of the laser beam emitted by the scanner unit 20. Thereby, an electrostatic latent image is formed on the surface of the photoconductive drum 32 based on the image data.

Subsequently, along with rotation of the development roller 36, the toner T held on the development roller 36 in a positively-charged state is supplied, when contacting the photoconductive drum 32, to the electrostatic latent image formed on the surface of the photoconductive drum 32, that is, to portions, of the evenly and positively charged surface of the photoconductive drum 32, which has an electrical potential lowered through the exposure to the laser beam. Thereby, the electrostatic latent image on the photoconductive drum 32 is visualized, and a toner image is held on the surface of the photoconductive drum 32 due to inversion development. After that, the toner image held on the surface of the photoconductive drum 32 is transferred onto the sheet 3 by the transfer bias applied to the transfer roller 34 when the sheet 3 passes between the photoconductive drum 32 and the transfer roller 34.

1.2.3. Configuration of Fixing Unit

The fixing unit 40 is provided on a downstream side of the process cartridge 30 in the sheet carrying direction. The fixing unit 40 includes a heating roller 41 and a pressing roller 42 configured to face the heating roller 41 via the sheet 3 and press the sheet 3 against the heating roller 41. The fixing unit 40 thermally fixes the toner T transferred onto the sheet 3 when the sheet 3 passes between the heating roller 41 and the pressing roller 42, and thereafter conveys the sheet 3 to a sheet ejecting path 44. The sheet 3 conveyed to the sheet ejecting path 44 is discharged onto a catch tray 46 by a sheet ejecting roller 45.

2. Configuration of Feeder Unit

Subsequently, a configuration of the feeder unit 4 will be described in detail. As illustrated in FIG. 1, the feed roller 61 has a feed roller gear 61*a* provided integrally and rotatably thereto. Further, the separation roller 62 has a separation roller gear 62*a* provided integrally and rotatably thereto. The feed roller gear 61*a* and the separation roller gear 62*a* engage with one another via an idle gear 63*a*, so as to rotate in the same direction in conjunction with one another.

The feed roller 61, the separation roller 62, the feed roller gear 61*a*, the separation roller gear 62*a*, and the idle gear 63*a* are rotatably supported in a holder 65, and constitute a feed roller assembly 60 as a whole. As illustrated in FIG. 2A, the holder 65 is provided swingably around a separation roller shaft 62*b*. Further, an end of the holder 65 at a side of the feed roller 61 is connected with a right end of a lift arm 71. It is noted that the separation roller shaft 62*b* is supported by a frame (not shown) so as to be rotatable integrally with the separation roller 62 in a predetermined position in the main body. Additionally, in the vicinity of a left end of the catch tray 11, a gear mechanism 80 for rotating the separation roller shaft 62*b* is provided.

The lift arm 71 is supported by the main body swingably around a supporting point 71*a* provided substantially in a center of the lift arm 71. The lift arm 71 has an engagement hole 71*b* formed at the right end thereof. The engagement hole 71*b* engages with a projection 65*a* provided at an end of the holder 65 on a side of the feed roller 61. In addition, a portion near a left end 71*c* of the lift arm 71 is biased upward by a tension coil spring (not shown). By the biasing force and an own weight of the feed roller assembly 60, the lift arm 71 is biased around the supporting point 71*a* in a counterclockwise direction in FIGS. 2A and 2C (namely, such that the right end of the lift arm 71 revolves downward).

2.1. Configuration of Gear Mechanism

Figure 3A:
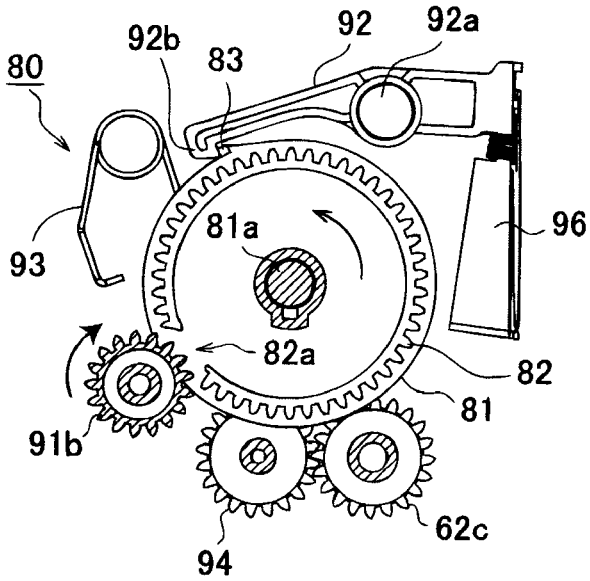
FIGS. 3A to 3C are a cross-sectional side view, a top view, and a left side view schematically showing the gear mechanism, respectively in the embodiment according to one or more aspects of the present invention.
Figure 3B:
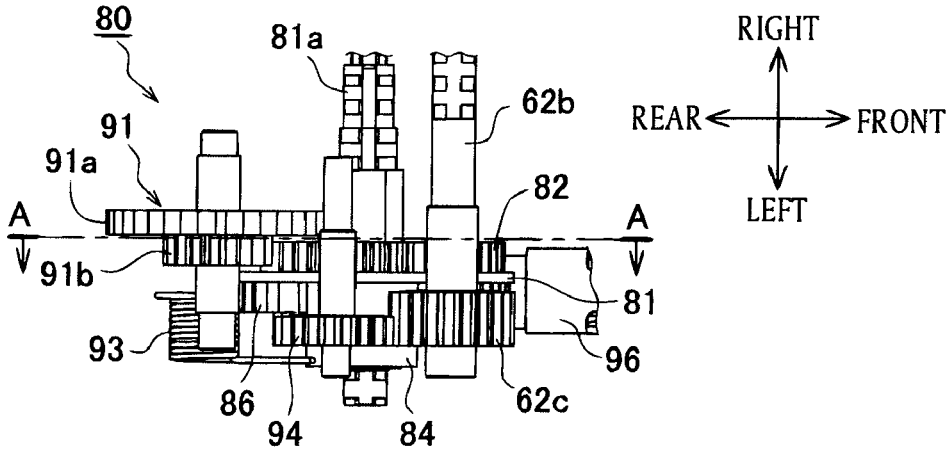
Figure 3C:
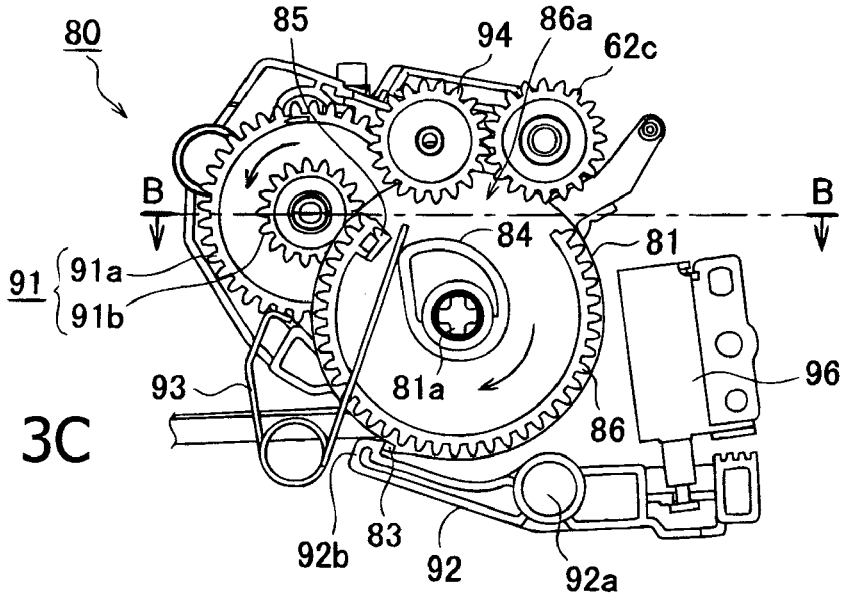
Figure 4:
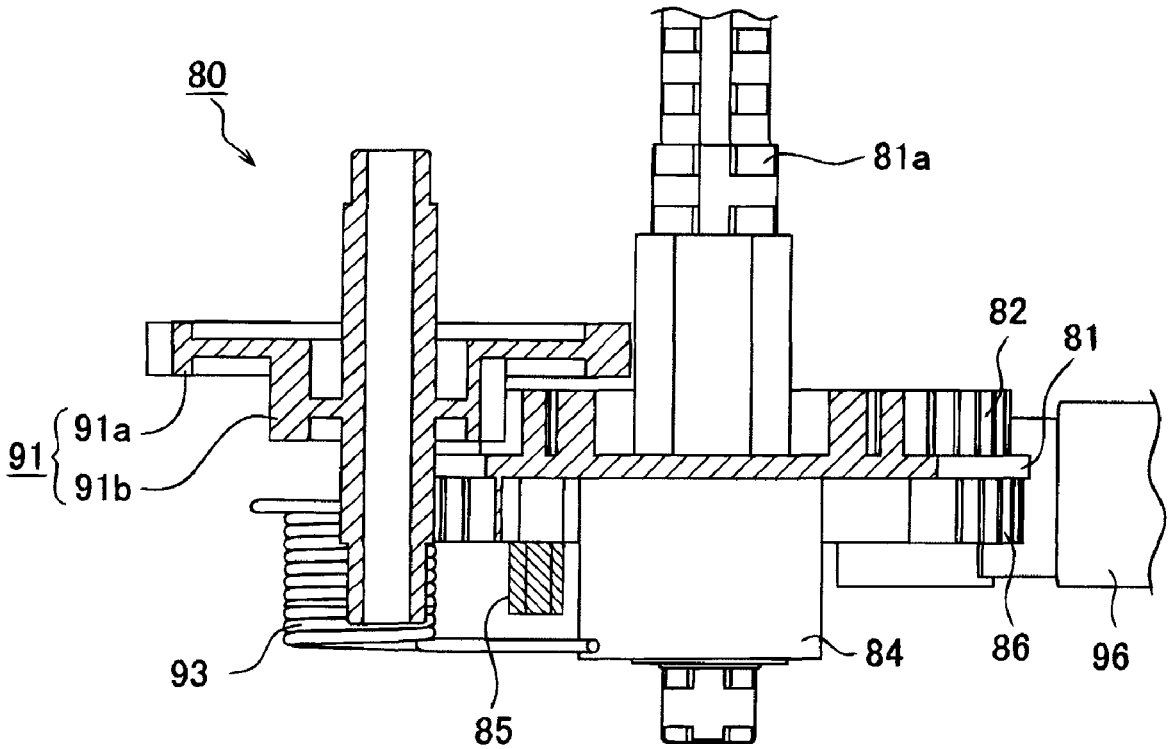
FIG. 4 is a cross-sectional top view schematically showing the gear mechanism in the embodiment according to one or more aspects of the present invention.

Next, a configuration of the aforementioned gear mechanism will be explained with reference to FIGS. 3 and 4. FIG. 3B is a top view schematically showing a configuration of the gear mechanism. FIG. 3A is a cross-sectional view of the configuration shown in FIG. 3B along an A-A line in FIG. 3B. FIG. 3C is a left side view of the configuration shown in FIG. 3B. FIG. 4 is a cross-sectional view of the configuration shown in FIG. 3C along a B-B line in FIG. 3C.

As illustrated in FIGS. 3A to 3C and 4, the gear mechanism 80 includes a sector gear 81 as a driving gear adopted to rotate around a shaft 81*a* extending in a left-to-right direction. Further, the gear mechanism 80 includes, around the sector gear 81, an input gear 91, a solenoid lever 92, a sector spring 93, an idle gear 94, and a separation roller driving gear 62*c*. Further, to meet a surrounding configuration, the sector gear 81 is formed integrally with a first tooth lacking gear 82, a locking projection 83, a first cam 84, a tooth portion 85 for reverse rotation, and a second tooth lacking gear 86. Hereinafter, the above elements will be described in detail.

The input gear 91 includes a large diameter gear 91*a* and a small diameter gear 91*b*. The large diameter gear 91*a* receives a driving force transmitted from a motor (not shown) via a gear mechanism (not shown). By the driving force, the small diameter gear 91*b* is driven in a direction indicated by respective arrows in FIGS. 3A and 3C. The first tooth-lacking gear 82 is formed to protrude from a right side face of the sector gear 81. Further, the first tooth lacking gear 82 is configured to engage with the small diameter gear 91*b* of the input gear 91 and to be driven in a direction indicated by respective arrows in FIGS. 3A and 3C. Additionally, the first tooth lacking gear 82 has a small tooth lacking portion 82*a* partially provided. When a center of the tooth lacking portion 82*a* faces the small diameter gear 91*b*, the driving force from the input gear 91 is not transmitted.

The solenoid lever 92 is provided to be swingable around a shaft 92*a* owing to excitation of a solenoid 96. The solenoid lever 92 has a locking claw 92*b* configured to engage with the locking projection 83 provided on an outer circumference of the sector gear 81. When the solenoid 96 is not excited, the locking claw 92*b* is in contact with the outer circumference of the sector gear 81. Then, when the locking claw 92*b* is engaged with the locking projection 83 through rotation of the sector gear 81, the rotation of the sector gear 81 is locked. Moreover, as illustrated in FIG. 3A, in a state where the engagement between the locking claw 92*b* and the locking projection 83 is established, the center of the tooth lacking portion 82*a* faces the small diameter gear 91*b*, and thereby the driving force is not transmitted from the input gear 91 to the sector gear 81. It is noted that, in the following description, a rotational position in which the locking claw 92*b* engages with the locking projection 83 will be referred to as a "home position."

The first cam 84 is formed to protrude from a left side face of the sector gear 81 and to have a substantially D-shaped cross-section perpendicular to the shaft 81*a* of the sector gear 81. A sector spring is formed with a twist coil spring and configured to contact an outer circumference of the first cam 84 with pressure. When a rotational force, generated in response to the sector spring 93 pressing the first cam 84, acts on the sector gear 81 in an arrow direction therefor (see FIGS. 3A and 3C), the following two operations are performed. Specifically, when the tooth lacking portion 82*a* faces the small diameter gear 91*b* such that the driving force is not transmitted to the sector gear 81, the locking projection 83 can certainly be engaged with the locking claw 92*b*. Further, when the locking claw 92*b* is unlocked from the locking projection 83, the first tooth lacking gear 82 is allowed to engage with the small diameter gear 91*b*.

The second tooth lacking gear 86 is formed to protrude from the left side face of the sector gear 81 and configured to engage with the separation roller driving gear 62*c* that rotates integrally with the separation roller shaft 62*b*. In addition, the second tooth lacking gear 86 has a tooth lacking portion 86*a* within a region in which the second tooth lacking gear 86 faces the idle gear 94 and the separation roller driving gear 62*c* in the home position.

As illustrated in FIG. 4, the tooth portion 85 for reverse rotation is formed to further protrude leftward from a left end face of the second tooth lacking gear 86 and to have a single tooth at a front end in a rotational direction of the second tooth lacking gear 86. Thereby, the tooth portion 85 for reverse rotation is configured to engage with the idle gear 94 in engagement with the separation roller driving gear 62*c*. It is noted that, as shown in FIG. 3B, the idle gear 94 is disposed in such a position as not to interfere with the second tooth lacking gear 86. Further, the separation roller driving gear 62*c* is configured to extend in the left-to-right direction long enough to engage with the second tooth lacking gear 86 ad the idle gear 94.

Figure 5A:
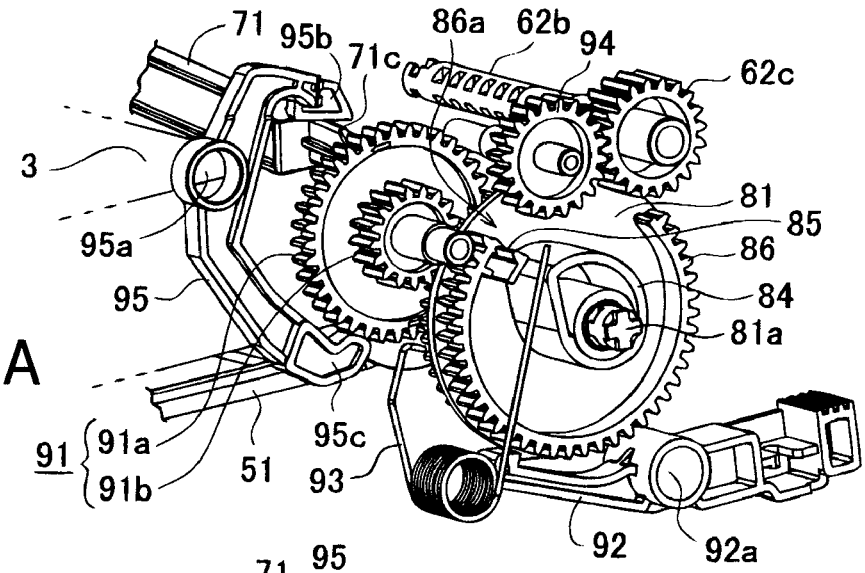
FIGS. 5A to 5C are perspective views showing an operation of the gear mechanism in the embodiment according to one or more aspects of the present invention.
Figure 5B:
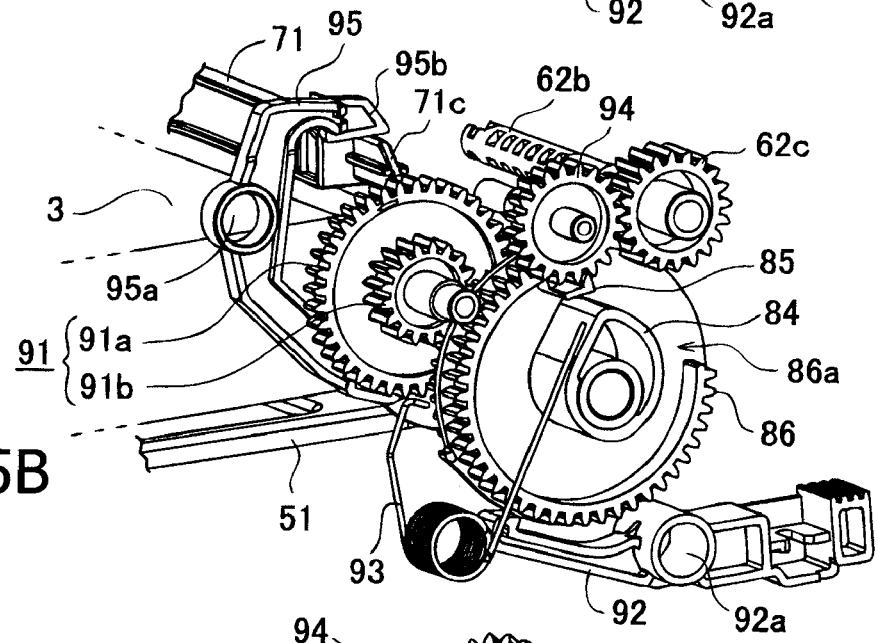
Figure 5C:
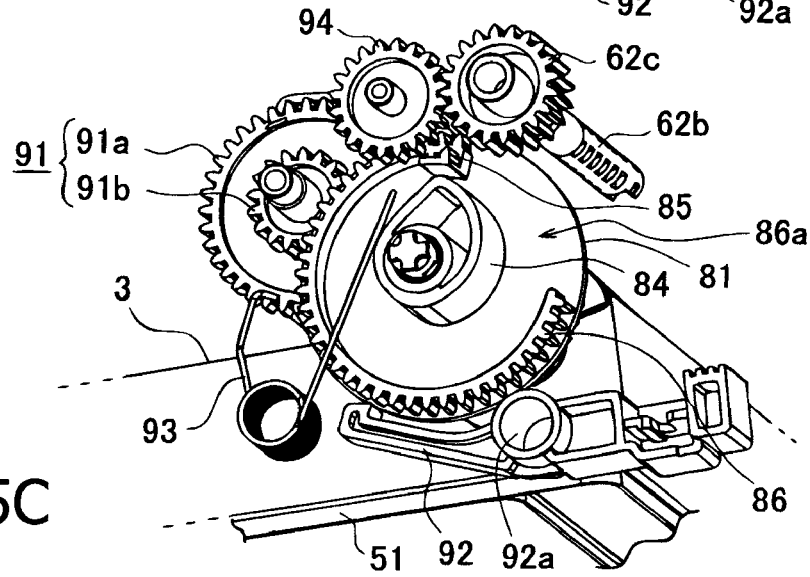

Therefore, when the solenoid 96 is excited in the home position shown in FIG. 5A in response to a sheet feed command being received, the driving force is transmitted from the input gear 91 to the sector gear 81, and the sector gear 81 begins to rotate in a clockwise direction in FIGS. 5A to 5C. Then, as shown in FIG. 5B, when the tooth portion 85 for reverse rotation engages with the idle gear 94, the driving force is transmitted from the sector gear 81 to the separation roller driving gear 62*c* via the idle gear 94, and the feed roller 61 and the separation roller 62 are driven to rotate reversely. The engagement between the tooth portion 85 for reverse rotation and the idle gear 94 is soon released. Subsequently, as illustrated in FIG. 5C, when the second tooth lacking gear 86 engages with the separation roller driving gear 62*c*, the feed roller 61 and the separation roller 62 are driven to rotate normally.

By the engagement between the second tooth lacking gear 86 and the separation roller driving gear 62*c*, the feed roller 61 and the separation roller 62 are normally rotated enough to feed a single sheet 3. Subsequently, the sector gear 81 is rotated to the home position and stopped. Thereby, as shown in FIG. 5A, both the separation roller driving gear 62*c* and the idle gear 94 face the tooth lacking portion 86*a* of the second tooth lacking gear 86, such that the driving force is not transmitted to feed roller 61 or the separation roller 62. Therefore, the feed roller 61 and the separation roller 62 become rotatable freely in the same direction, and thus further feeding of the sheet 3 can easily be carried out by the sheet powder removing roller 13.

Additionally, as illustrated in FIGS. 2B and 2D, the left end 71*c* of the lift arm 71 engages with an upper end 95*b* of the lift lever 95 from above. A second cam 97, which is a cam configured to rotate integrally with the sector gear 81 via a shaft 81*a* thereof, is fixed to the shaft 81*a* of the sector gear 81. Further, the second cam 97 is adopted to contact a lower end 95*c* of the lift lever 95. It is noted that the shaft 81*a* is not shown in FIGS. 2D and 5B. The second cam 97 is formed to have a substantially semilunar cross-section perpendicular to the shaft 81*a*. Further, an end of a chord of the semilunar cross-section is disposed close to the shaft 81*a*.

When the sector gear 81 is in the home position, the second cam 97 presses rearward the lower end 95*c* of the lift lever 95 as shown in FIG. 2B. In this state, the lift lever 95 is swung around the shaft 95*a* thereof in the clockwise direction in FIGS. 2B and 2D, and the upper end 95*b* of the lift lever 95 presses downward the left end 71*c* of the lift arm 71. Therefore, the lift arm 71 is rotated in the clockwise direction in FIGS. 2A and 2C against the biasing force of the aforementioned tension coil spring and the weight of the feed roller assembly 60. Thus, as illustrated in FIG. 2A, the feed roller 61 is spaced apart from the top sheet of the stack of sheets 3 placed on the pressing plate 51.

Meanwhile, when the engagement between the second cam 97 and the lower end 95*c* of the lift lever 95 is released as shown in FIG. 2D along with the second cam 97 rotating integrally with the sector gear 81, the lift arm 71 is rotated around the supporting point 71*a* in the counterclockwise direction in FIGS. 2A and 2C due to the biasing force of the tension coil spring and the weight of the feed roller assembly 60. Thereby, as illustrated in FIG. 2C, the feed roller 61 comes into contact with the top sheet of the stack of sheets 3 placed on the pressing plate 51, so that the top sheet can be fed.

2.2. Operations and Effects of Gear Mechanism

Figure 6:
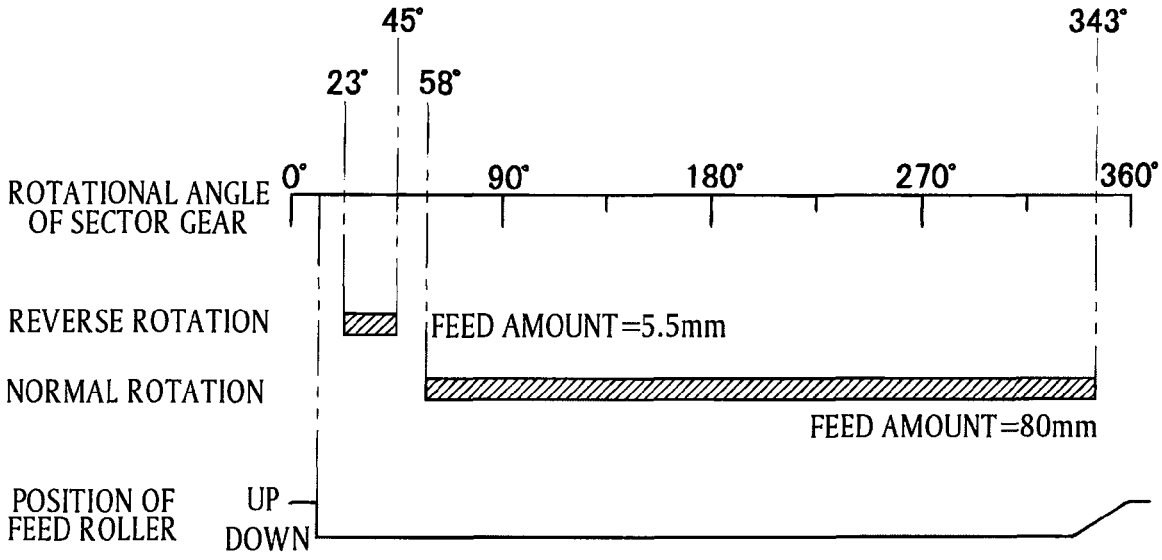
FIG. 6 is a schematic diagram showing relationship between a rotational angle of a sector gear and each operation of elements in the gear mechanism in the embodiment according to one or more aspects of the present invention.

Therefore, while the sector gear 81 is rotated in a predetermined direction indicated by the arrow in FIGS. 3A to 3C as mentioned above, the gear mechanism 80 can drive elements thereof as follows. FIG. 6 is a schematic diagram showing relationship between a rotational angle of the sector gear 81 (0 degree in the home position) and each operational state of elements in the gear mechanism 80.

As shown in FIG. 6, when the sector gear 81 is in the home position (the rotational angle=0 degree), the feed roller 61 is in a high position. Further, at this time, the driving force is not transmitted to the feed roller 61 or the separation roller 62. Then, when the solenoid 96 is excited, and the sector gear 81 is rotated even slightly (for example, about 10 degrees), the engagement between the second cam 97 and the lower end 95*c* of the lift lever 95 is unlocked. Thus the feed roller 61 declines.

While the sector gear 81 further rotates to increase the rotational angle thereof from 23 degrees to 45 degrees, the feed roller 61 and the separation roller 62 are driven to rotate reversely due to the engagement between the tooth portion 85 for reverse rotation and the idle gear 94. When the rotational angle of the sector gear 81 exceeds 45 degrees, the engagement between the tooth portion 85 for reverse rotation and the idle gear 94 is released. Thereby, the driving force is not transmitted to the feed roller 61 or the separation roller 62. Then, while the sector gear 81 further rotates to increase the rotational angle thereof from 58 degrees to 343 degrees, the feed roller and the separation roller 62 are driven to rotate normally due to the engagement between the second tooth lacking gear 86 and the separation roller driving gear 62*c*.

In addition, around the time when the rotational angle of the sector gear 81 reaches 343 degrees, the second cam 97 comes into contact with the lower end 95*c* of the lift lever 95, and the feed roller 61 is gradually lifted up. Further, while the rotational angle of the sector gear 81 reaches the aforementioned angle 23 degrees from 343 degrees, the driving force is not transmitted to the feed roller 61 or the separation roller 62. It is noted that, as mentioned above, while the rotational angle of the sector gear 81 reaches the aforementioned angle 23 degrees from 343 degrees, the sector gear 81 is stopped in the home position due to the engagement between the locking projection 83 and the locking claw 92*b*.

Figure 7:
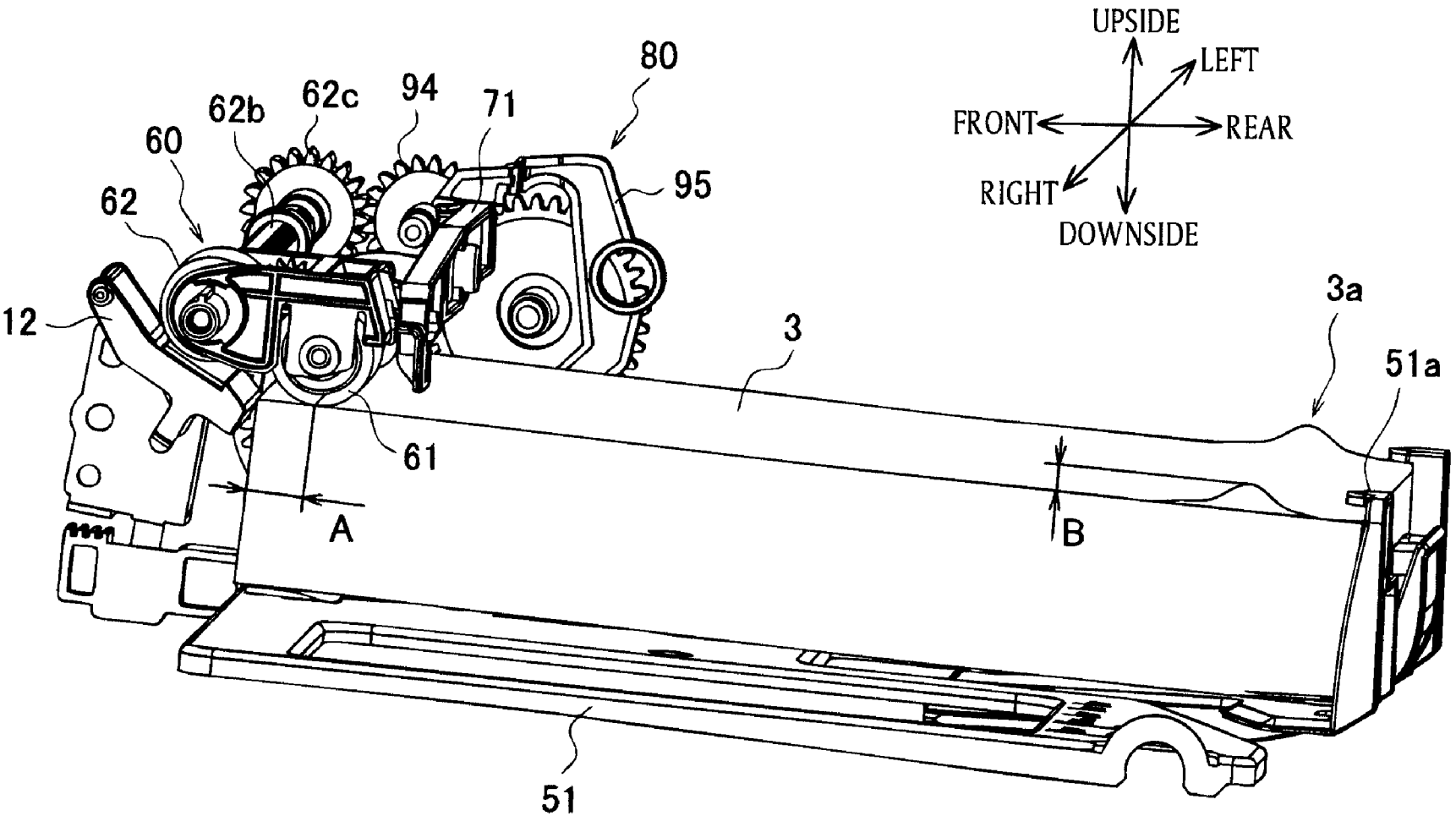
FIG. 7 is a perspective view showing an effect provided by reverse rotation of the feed roller in the embodiment according to one or more aspects of the present invention.

A feed amount due to the reverse rotation of the feed roller 61 is 5.5 mm. The feed amount is, as illustrated in FIG. 7, shorter than a distance A (for example, 8 mm) from a front end of the sheets 3 placed on the pressing plate 51 to a contact line between the top sheet of the stack of sheets 3 and the feed roller 61. Therefore, it is impossible for the feed roller 61 to contact a second sheet 3 from the top in the reverse rotation. Moreover, when the top sheet 3 is fed rearward in the reverse rotation, and a rear end of the top sheet 3 comes into contact with a rear guide 51*a* provided integrally with the pressing plate 51, the top sheet 3 is partially lifted up to be formed with a curling portion 3*a*. A height B of the bending portion 3*a* is about 10 mm to 15 mm, which is enough to separate, from the second sheet 3, the top sheet 3 by partially curling the top sheet 3 through the reverse rotation.

Therefore, in the embodiment, as described above, although the driving force is applied to the sector gear 81 in a predetermined rotational direction, the feed roller 61 can be reversely rotated once and thereafter normally rotated. Thereby, it is possible to prevent two or more sheets from being fed together at once in a sheet feeding operation. Further, the feed amount in the normal rotation is a sufficient amount of 80 mm as shown in FIG. 6. Hence, the feed roller 61 can convey the sheet 3 to between the sheet powder removing roller 13 and the opposed roller 14 in conjunction with the separation roller 62 in a preferable manner. Additionally, in the embodiment, it is possible to certainly separate the sheet 3 on a sheet-by-sheet basis by holding the sheet 3 fed by the feed roller 61 between the separation roller 62 and the separation pad 12. Further, the separation roller 62 is rotated once reversely and thereafter normally in the same manner as the feed roller 61. Therefore, even though the feed roller 61 is normally rotated needlessly in a previous sheet feeding operation, and the second sheet 3 from the top is conveyed up to the separation roller 62, owing to the aforementioned reverse rotation of the separation roller 62, it is possible to prevent two or more sheets 3 from being fed together at once in a sheet feeding operation.

Further, in the embodiment, the angular range (23 to 45 degrees) of the sector gear 81 in which the feed roller 61 and the separation roller 62 are reversely rotated and the angular range (58 to 343 degrees) of the sector gear 81 in which the feed roller 61 and the separation roller 62 are normally rotated are provided sequentially and closely to be adjacent to one another. Hence, the normal rotation can be achieved immediately after the reverse rotation. Therefore, it is possible to prevent two or more sheets 3 from being fed together at once in a more preferable manner, and to form an image with the image forming unit 5 certainly on the sheet-by-sheet basis. Additionally, around the home position (specifically, from 343 to 23 degrees in the rotational angle of the sector gear 81), the feed roller 61 and the separation roller 62 are freely rotated, and the feed roller 61 is separated apart from the top sheet 3 by the second cam 97. Therefore, a further feeding operation can easily be performed by the sheet powder removing roller 13.

Further, in the embodiment, the feed roller 61 is lifted up in the aforementioned manner such that the driving force is not transmitted to the feed roller 61 or the separation roller 62. It is possible to prevent two or more sheets 3 from being fed together at once due to continuous normal rotation. Additionally, the aforementioned vertical motion of the feed roller 61 is attained by the second cam configured to rotate integrally with the sector gear 81. Therefore, the vertical motion of the feed roller 61 and coordination between rotational states of the fed roller 61 and the separation roller 62 can certainly be achieved with a simply configured mechanism.

Hereinabove, the embodiment according to aspects of the present invention have been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of its versatility are shown and described in the present disclosure. It is to be understood that the present invention is capable of use in various other combinations and environments and is capable of changes or modifications within the scope of the inventive concept as expressed herein. For example, the present invention is capable of the following modifications.

The feed roller 61 may be configured to double as the separation roller 62. The feed roller 61 may not be configured to move vertically. In addition, yet more gears may be provided between the sector gear 81 and the separation roller driving gear 62*c*.

What is claimed is:

1. A sheet feeder, comprising:

a feed roller configured to contact and feed a top sheet of a stack of sheets while rotating in a predetermined feeding direction;

an input gear mechanism for transmitting a driving force;

a driving gear configured to be rotated in a predetermined direction and transmit the driving force received from the input gear mechanism, the driving gear including a tooth lacking portion, wherein the input gear mechanism does not transmit the driving force to the driving gear when the driving gear is in a home position in which the tooth lacking portion faces the input gear mechanism, and a locking projection;

a first gear mechanism configured to transmit the driving force from the driving gear to the feed roller so as to rotate the feed roller in a reverse direction opposite to the feeding direction;

a second gear mechanism configured to transmit the driving force from the driving gear to the feed roller so as to rotate the feed roller in the feeding direction; and a locking member configured to engage with the locking projection through rotation of the driving gear, and lock rotation of the driving gear in the home position, wherein the driving gear further includes:

a first engaging member configured to engage with the first gear mechanism and transmit the driving force to the first gear mechanism when a rotational angle of the driving gear is within a first range; and a second engaging member configured to engage with the second gear mechanism and transmit the driving force to the second gear mechanism when the rotational angle of the driving gear is within a second range that has no common range with the first range.

2. The sheet feeder according to claim 1, wherein the first range and the second range are provided sequentially and repeatedly along with rotation of the driving gear, and wherein there is a third range between the first range and the second range, the third range being a range in which transmission of the driving force to the first gear mechanism and the second gear mechanism is blocked.

3. The sheet feeder according to claim 1, further comprising:

a separation roller configured to rotate in a direction identical to a rotational direction of the feed roller in conjunction with the feed roller, the separation roller being adopted to further feed the sheet fed by the feed roller; and a separation pad that faces the separation roller and is configured to press the sheet against the separation roller.

4. The sheet feeder according to claim 2, further comprising a spacing mechanism configured to, after the feed roller has fed the sheet while rotating in the feeding direction, space the feed roller apart from a top sheet of the stack of sheets, wherein the driving gear includes a cam formed integrally therewith, the cam being configured to operate the spacing mechanism.

5. The sheet feeder according to claim 1, wherein the second range is wider than the first range.

6. The sheet feeder according to claim 3, wherein the separation pad includes a resilient portion provided to face the separation roller.

7. The sheet feeder according to claim 1, wherein the first gear mechanism includes a first gear and a second gear configured to engage with the first gear, wherein the second gear mechanism shares the second gear with the first gear mechanism, wherein the first engaging member is configured to engage with the first gear to rotate the feed roller in the reverse direction when the rotational angle of the driving gear is within the first range, and wherein the second engaging member is configured to engage with the second gear to rotate the feed roller in the feeding direction when the rotational angle of the driving gear is within the second range.

8. An image forming device, comprising:

a sheet feeder configured to feed a top sheet of a stack of sheets; and an image forming unit configured to form an image on the sheet fed by the sheet feeder, wherein the sheet feeder comprises:

a feed roller configured to contact and feed the top sheet of the stack of sheets while rotating in a predetermined feeding direction;

an input gear mechanism for transmitting a driving force;

a driving gear configured to be rotated in a predetermined direction and transmit the driving force received from the input gear mechanism, the driving gear including a tooth lacking portion, wherein the input gear mechanism does not transmit the driving force to the driving gear when the driving gear is in a home position in which the tooth lacking portion faces the input gear mechanism, and a locking projection;

a first gear mechanism configured to transmit the driving force from the driving gear to the feed roller so as to rotate the feed roller in a reverse direction opposite to the feeding direction;

a second gear mechanism configured to transmit the driving force from the driving gear to the feed roller so as to rotate the feed roller in the feeding direction; and a locking member configured to engage with the locking projection through rotation of the driving gear, and lock rotation of the driving gear in the home position, wherein the driving gear further includes:

a first engaging member configured to engage with the first gear mechanism and transmit the driving force to the first gear mechanism when a rotational angle of the driving gear is within a first range; and a second engaging member configured to engage with the second gear mechanism and transmit the driving force to the second gear mechanism when the rotational angle of the driving gear is within a second range that has no common range with the first range.

9. The image forming device according to claim 8, wherein the first range and the second range are provided sequentially and repeatedly along with rotation of the driving gear, and wherein there is a third range between the first range and the second range, the third range being a range in which transmission of the driving force to the first gear mechanism and the second gear mechanism is blocked.

10. The image forming device according to claim 8, wherein the sheet feeder further comprises:

a separation roller configured to rotate in a direction identical to a rotational direction of the feed roller in conjunction with the feed roller, the separation roller being adopted to further feed the sheet fed by the feed roller; and a separation pad that faces the separation roller via the sheet and is configured to press the sheet against the separation roller.

11. The image forming device according to claim 9, wherein the sheet feeder further comprises a spacing mechanism configured to, after the feed roller has fed the sheet while rotating in the feeding direction, space the feed roller apart from a top sheet of the stack of sheets, and wherein the driving gear includes a cam formed integrally therewith, the cam being configured to operate the spacing mechanism.

12. The image forming device according to claim 8, wherein the second range is wider than the first range.

13. The image forming device according to claim 10, wherein the separation pad includes a resilient portion provided to face the separation roller.

14. The image forming device according to claim 8, wherein the first gear mechanism includes a first gear and a second gear configured to engage with the first gear, wherein the second gear mechanism shares the second gear with the first gear mechanism, wherein the first engaging member is configured to engage with the first gear to rotate the feed roller in the reverse direction when the rotational angle of the driving gear is within the first range, and wherein the second engaging member is configured to engage with the second gear to rotate the feed roller in the feeding direction when the rotational angle of the driving gear is within the second range.

15. The image forming device according to claim 8, wherein the sheet feeder further comprises:

a driving member configured to control when the locking member engages with the locking projection.

16. The image forming device according to claim 15, wherein the driving member includes a solenoid, which in a first state causes the locking member to engage with the locking projection and in a second state causes the locking member to disengage with the locking projection.

17. The image forming device according to claim 8, wherein the input gear mechanism includes a first gear which receives the driving force, and a second gear for transmitting the driving force, wherein the first gear and the second gear have different diameters.

18. The sheet feeder according to claim 1, further comprising:

a driving member configured to control when the locking member engages with the locking projection.

19. The sheet feeder according to claim 18, wherein the driving member includes a solenoid, which in a first state causes the locking member to engage with the locking projection and in a second state causes the locking member to disengage with the locking projection.

20. The sheet feeder according to claim 1, wherein the input gear mechanism includes a first gear which receives the driving force, and a second gear for transmitting the driving force, wherein the first gear and the second gear have different diameters.

* * * * *